United States Patent [19]

Saarinen

[11] Patent Number: 4,867,440

[45] Date of Patent: Sep. 19, 1989

[54] ARRANGEMENT FOR AN EXERCISE DEVICE

[75] Inventor: Sulevi Saarinen, Ilmarinen, Finland

[73] Assignee: Tunturipyora Oy, Turku, Finland

[21] Appl. No.: 236,752

[22] Filed: Aug. 26, 1988

[30] Foreign Application Priority Data

Aug. 31, 1987 [FI] Finland ..... 873764

[51] Int. Cl.[4] ..... A63B 69/06

[52] U.S. Cl. ..... 272/72; 272/130

[58] Field of Search ..... 272/69, 70, 72, 97, 272/130, 144, 134, 135, 136, 137, 138, 139, 145, 120, 117, 132; D21/191-195

[56] References Cited

U.S. PATENT DOCUMENTS

| | | | |
|---|---|---|---|
| 1,920,574 | 8/1933 | Luzzi | 272/72 |
| 4,627,610 | 12/1986 | Ishida | 272/72 |
| 4,695,050 | 9/1987 | Smith et al. | 272/72 |
| 4,736,944 | 4/1988 | Johnson | 272/130 |

FOREIGN PATENT DOCUMENTS

| | | | |
|---|---|---|---|
| 0698353 | 1/1931 | France | 272/72 |

*Primary Examiner*—S. R. Crow

*Attorney, Agent, or Firm*—Lyon & Lyon

[57] ABSTRACT

The invention relates to an arrangement for an exercise device. The arrangement comprises a bogie provided with running rolls for supporting a seat on a rail part. The edges of the rail part are provided with flanges so that the running rolls have room enough between the flanges. The lower flanges are thereby arranged to act as rolling surfaces for the runnng rolls when the bogie is positioned on the rail part. In order that the seat would move reliably on the rail part, a counter roll is provided on both sides of the bogie between the running rolls. The lower edge of the counter roll is arranged to be positioned at a distance from the rolling surface when the running rolls are supported on the rolling surfaces. The upper flanges are provided with counter surfaces which are supported only on the upper surfaces of the counter rolls when the running rolls rise off the rolling surfaces.

6 Claims, 2 Drawing Sheets

FIG. 1
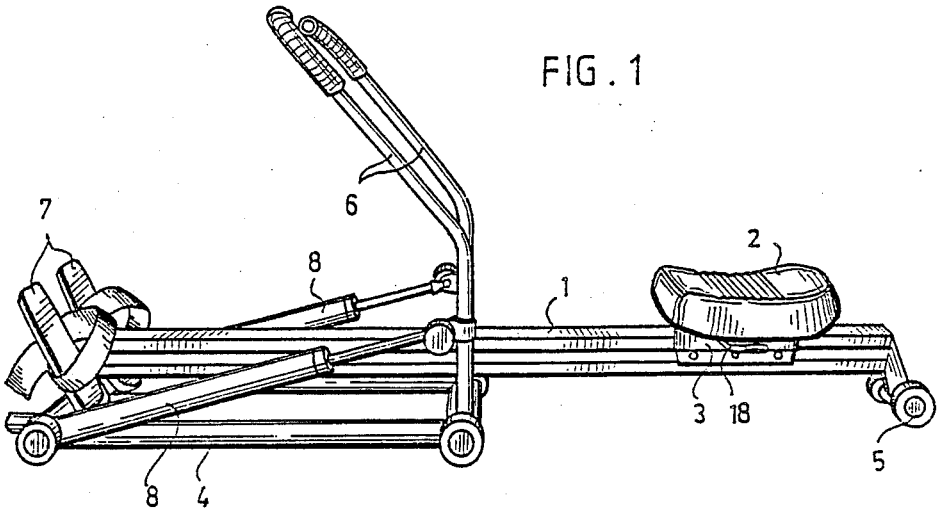
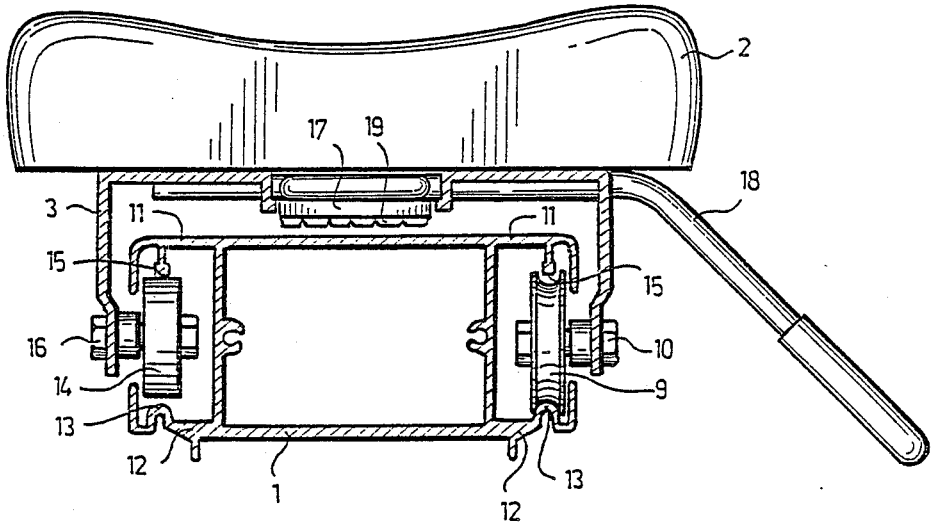
FIG. 4

FIG. 2
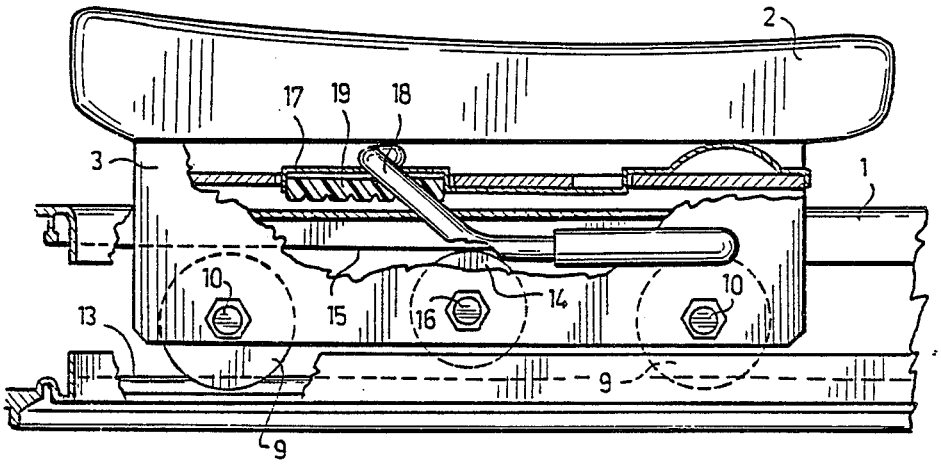
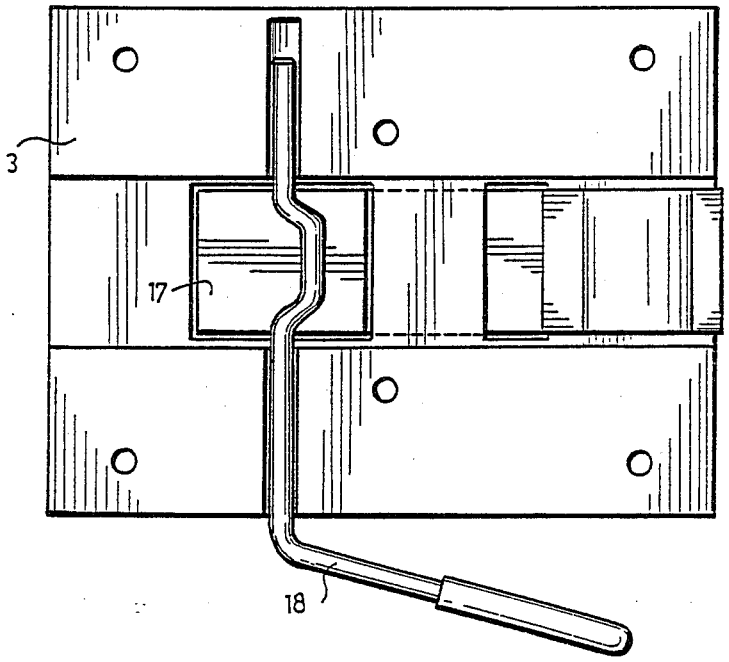
FIG. 3

ARRANGEMENT FOR AN EXERCISE DEVICE

The invention relates to an arrangement for an exercise device, comprising an elongated rail part and a bogie provided with at least four running rolls for supporting a seat on the rail part, whereby substantially horizontal flanges are arranged at the longitudinal edges of the rail part, said flanges being vertically spaced from each other in such a manner that the running rolls have room enough between the flanges, whereby the lower ones of said flanges are arranged to act as rolling surfaces for the running rolls while the bogie is positioned on the rail part.

This kind of arrangements are today well-known in connection with exercise devices. Such devices include rowing devices in which the seat is positioned slidably on a rail part. Known solutions include the rowing device recited in U.S. Pat. No. 4,541,627.

A drawback of known solutions has been, for instance, the poor movability of the seat since the friction between the running rolls and the rail part tends to increase too much, whereby the movement of the seat gets jerky thus disturbing the performance. The problem is further aggravated by the fact the seat does not move smoothly in the horizontal plane during the rowing but sways and rises intermittently in the vertical direction depending on the rower and the rowing rhythm.

The object of the invention is to provide an arrangement by means of which the above-mentioned drawback can be eliminated. This is achieved by means of an arrangement according to the invention which is characterized in that at least one counter roll is provided in the bogie on both sides thereof between the running rolls, the lower edge of said counter roll being arranged to be positioned at a distance from the rolling surface when the running rolls are supported on the rolling surfaces and that the upper flanges of the rail part are provided with counter surfaces which are arranged to be supported only on the upper surfaces of the counter rolls when the bogie is tilted or rises so that the running rolls rise off the rolling surfaces.

An advantage of the invention is that the friction between the running rolls of the seat and the rail part does not increase disturbingly even though the position of the seat would vary during the performance. In the arrangement according to the invention the seat is also extremely well supported, so an excessive varying of the position of the seat does not disturb the performance. Furthermore, the manufacturing costs of the arrangement according to the invention are low, so the invention can be applied advantageously.

In the following the invention will be described in more detail by means of one preferred embodiment of the invention shown in the attached drawing, wherein:

FIG. 1 is a general view of a rowing device in which the arrangement according to the invention is utilized;

FIG. 2 is a general side view of the arrangement according to the invention;

FIG. 3 is a top view of the arrangement of FIG. 2; and

FIG. 4 illustrates generally the arrangement of FIGS. 2 and 3 in the direction of the rail part.

FIG. 1 shows generally a rowing device in which the arrangement according to the invention is utilized. The reference numeral 1 indicates a rail part which forms the frame of the rowing device. A seat 2 is arranged movably on the rail part 1. The seat 2 is connected to the rail part 1 by means of a bogie 3.

The device of FIG. 1 further comprises supports 4, 5; oars 6; foot supports 7; and dampers 8. The structure and operation of these parts belong to the prior art, so they are not more closely discussed herein. As to the operation of the rowing device itself, it is to be mentioned herein merely that the seat 2 moves to and fro on the rail part 1 during the rowing.

FIGS. 2 to 4 show an arrangement according to the invention. The same reference numerals as in FIG. 1 are used in FIGS. 2 to 4 for corresponding parts.

The seat 2 is fastened to the bogie 3 in a suitable way. The bogie 3 comprises two running rolls 9 at both edges thereof. The running rolls are arranged to rotate around horizontal rotation shafts 10. The longitudinal edges of the rail part 1 are provided with substantially horizontal flanges 11, 12. The flanges 11, 12 are vertically spaced from each other in such a manner that the running rolls 9 have room enough between the flanges. The lower flanges 12 of the rail part 1 or parts of said flanges are arranged to act as rolling surfaces 13 for the running rolls 9 while the bogie 3 is positioned on the rail part 1.

According to the invention at least one counter roll 14 rotatable around a horizontal shaft 16 is provided in the bogie 3 on both sides thereof between the running rolls 9. The lower edge of each counter roll 14 is arranged to be positioned at a distance from the rolling surface 13 when the running rolls 9 are supported on the rolling surfaces 13. The upper flanges 11 at the edges of the rail part 1 are provided with counter surfaces 15. The counter surfaces 15 are arranged to be supported only on the upper surfaces of the counter rolls 14, i.e. on the uppermost point of the peripheral surface when the bogie is tilted or rises upwards so that the running rolls 9 rise off the rolling surfaces 13.

Accordingly, it is essential in the invention that when the seat is positioned on the rail part 1, the running rolls of the bogie 3 are supported only on the rolling surfaces 13. When the seat and as a consequence the bogie are tilted so that the running rolls rise off the rolling surfaces, the counter rolls 14 are supported on the counter surfaces 15. In other words, the running rolls 9 do not at all make contact with the counter surfaces 15 and, correspondingly, the counter rolls 14 do not make contact with the rolling surfaces 13. For this reason, the movement of the seat on the rail part 1 is as light as possible, that is, the seat portion moves without jerks so that the rowing performance is pleasant and light.

In the example of the figures, the diameter of the counter rolls 14 is smaller than that of the running rolls 9. In addition, the rotation shafts 16 of the counter rolls are positioned higher than the rotation shafts 10 of the running rolls 9. This arrangement as well as the spaces between the counter rolls 14 and the rolling surfaces 13 and the running rolls 9 and the counter surfaces 15 appear clearly from FIGS. 2 and 4. In the example of the figures, the peripheral surface of the running rolls 9 is troughlike so that the surface is positioned lower than the uppermost point of the periphery of the counter roll. This, of course, is not the only possible solution but a corresponding operation can also be achieved simply by positioning the rotation shaft of the running rolls, for instance, in a suitable manner, etc.

The bogie 3 is further provided with a braking means 17 movable with respect to the bogie. When locking the bogie 3 in place, the braking means 17 can be displaced so that it is pressed against the upper surface of the rail part 1. When the braking means 17 is pressed against the rail part 1, the bogie 3 rises correspondingly upwards, whereby the running rolls 9 rise off the rolling surfaces 13 and the upper surfaces of the counter rolls 14 are pressed against the counter surfaces 15. By means of this operation the bogie 3 as well as the seat 2 can be locked steadily in place e.g. for performing movements for strengthening abdominal muscles. When the counter rolls 14 are supported on the counter surfaces 15, the bogie is also kept stationary in the sideward direction.

In the example of the figures the braking means 17 is arranged to move by means of an eccentric lever 18. In the braking means 17 a surface 19 to be pressed against the rail part 1 can be manufactured of a rubber material, for instance.

The above embodiment is by no means intended to restrict the invention but the invention can be modified within the scope of the claims in various ways. Accordingly, it is obvious that the arranement according to the invention or the parts thereof need not necessarily be exactly similar to those shown in the figures. For instance, the rail part need not be such as shown in the figures but other kind of solutions are possible as well. The rail part can be made of an aluminium profile or of some other material; it can be assembled of separate parts, etc. The rolling surfaces and the peripheral surfaces of the running rolls may, of course, be shaped otherwise than in the figures. These matters also apply to the counter rolls and the counter surfaces. The braking means may be movable by means of a mechanism other than that shown in the figures, e.g. by means of a screw mechanism. That surface of the braking means which is pressed against the rail part can be manufactured of some other material than rubber, such as plastic.

I claim:

1. A support for an exercise device comprising in combination, a rail part having opposite longitudinal edges and spaced upper and lower flanges at each of said longitudinal edges, a seat assembly having a pair of running rollers on each side thereof between said upper and lower flanges, said running rollers being engaged on and movable along said lower flanges while being spaced from said upper flanges when the seat assembly is in a horizontal position, the spacing between the running rollers and the upper flanges allowing the running rollers to move vertically between the upper and lower flanges when the seat assembly is tilted, said seat assembly further having a pair of counter rollers respectively located on opposite sides thereof between said running rollers, said counter rollers being spaced from said lower and upper flanges and engageable with the upper flanges when the seat assembly is tilted to thereby prevent engagement between the running rollers and said upper flanges.

2. The support according to claim 1, wherein the seat assembly comprises a braking means movable with respect to the seat assembly and arranged to be pressed against an upper surface of the rail part to lock the seat assembly in place and simultaneously to lift the seat assembly upwards so that the running rollers rise off the lower flanges and upper surfaces of the counter rollers are pressed against the upper flanges.

3. The support according to claim 2, wherein the braking means includes an eccentric level for moving the braking means.

4. The support according to claim 2 or 3, wherein the braking means includes a rubber surface to be pressed against the rail part.

5. The support according to claim 1 wherein the diameter of the counter rollers is smaller than the diameter of the running rollers.

6. The support according to claim 1, or 5, wherein rotation shafts for the counter rolls are positioned higher than rotation shafts for the running rolls.

* * * * *